United States Patent [19]

Goldsmith

[11] 4,007,964

[45] Feb. 15, 1977

[54] PREFERENTIAL SOLUTION MINING PROCESS

[75] Inventor: Elmar L. Goldsmith, Regina, Canada

[73] Assignee: PPG Industries Canada Ltd., Regina, Canada

[22] Filed: Sept. 23, 1975

[21] Appl. No.: 616,101

[52] U.S. Cl. ..... 299/4; 299/5

[51] Int. Cl.[2] ..... E21B 43/28

[58] Field of Search ..... 299/4, 5

[56] References Cited

UNITED STATES PATENTS

| | | | |
|---|---|---|---|
| 2,787,455 | 4/1957 | Knappen | 299/5 |
| 2,976,690 | 3/1961 | Allred et al. | 299/5 X |
| 3,433,530 | 3/1969 | Dahms et al. | 299/4 |
| 3,442,553 | 5/1969 | Kutz | 299/4 |
| 3,914,945 | 10/1975 | Bietlot | 299/4 X |

*Primary Examiner*—Ernest R. Purser
*Assistant Examiner*—George A. Suchfield
*Attorney, Agent, or Firm*—Richard M. Goldman; Irwin M. Stein

[57] ABSTRACT

Disclosed is a method of preferentially solution mining potassium chloride from a stratified subterranean deposit of potassium chloride and sodium chloride where a plurality of strata are present in a single common solution mining cavity. According to an embodiment of the disclosed method, a first aqueous working solution is established in a lower zone of the cavity in contact with lower strata. Thereafter, a second aqueous working solution is established in contact with a higher zone intended to be preferentially mined. The second aqueous working solution is maintained at a lower specific gravity than the first aqueous working solution. Effluent is withdrawn from the second aqueous working solution near the lower boundary thereof and an extracting solution is added to the cavity at a rate sufficient to maintain the second aqueous working solution less dense than the subjacent solution, i.e., the first aqueous working solution. The disclosed method is useful in preferentially mining zones that have a potassium chloride content substantially different than adjacent zones.

22 Claims, 17 Drawing Figures

PREFERENTIAL SOLUTION MINING PROCESS

DESCRIPTION OF THE INVENTION

Potassium chloride frequently occurs in mineral deposits closely associated with sodium chloride. In many cases the potassium chloride exists in admixture with the sodium chloride in the form of a salt deposit having a plurality of strata of various potassium chloride and sodium chloride concentrations. A typical stratum may contain from about 15 to about 50 percent or more by weight potassium chloride, based on the total weight of potassium chloride and sodium chloride in the deposit, thereby providing a weight ratio of potassium chloride to sodium chloride of from about 1:1 to about 1:6.

The mineral deposits of potassium chloride and sodium chloride usually contain other substances, such as clays, salts, e.g., calcium sulfate, magnesium sulfate, magnesium chloride, and the like. These salts are usually present in small quantities, for example, from traces, e.g., from fractions of a percent, up to about 15 weight percent, and most frequently about 1 to 2 weight percent.

Subterranean deposits of potassium chloride and sodium chloride, such as described above, are frequently very deep. Typically, such deposits, e.g., those found in Canada, are at depths of more than 3,000 feet below the surface of the earth. These Canadian deposits ae characterized by a plurality of strata of varying sodium chloride and potassium chloride composition. Single stratum of substantially uniform composition may be from less than an inch thick to more than 70 feet thick. Potassium chloride rich strata, i.e., those containing more than about 25 weight percent potassium chloride, basis total potassium chloride and sodium chloride in the stratum, are generally from about 4 feet thick to about 70 feet thick and most frequently from about 5 feet thick to about 20 feet thick. Potassium chloride lean strata, i.e., those containing less than 25 weight percent potassium chloride, basis total potassium chloride and sodium chloride, are generally from about 8 feet thick to about 50 feet thick. Additionally, there may be clay strata through the deposit.

In solution mining of these deposits, a solution mining cavity is normally established at a convenient level within the deposit to be mined, as is well known in the art. The feed to the solution mining cavity, that is, the extracting solution, also referred to in the art as the aqueous solvent, the solvent, the aqueous extracting solution, or, simply, the feed, may be either substantially pure water or a dilute aqueous solution of sodium chloride or a dilute aqueous solution of potassium chloride or a dilute aqueous solution of potassium chloride and sodium chloride. As used herein, the term "extracting solution" is intended to mean a solution capable of solubilizing potassium chloride. The aqueous solvent fed to a solution mining cavity may be water and it may contain sodium chloride, e.g., up to about 130 or even 150 grams per liter of sodium chloride and small amounts of potassium chloride, e.g., up to about 10 grams per liter of potassium chloride.

As the feed of solvent is introduced to the cavity, it dissolves potassium chloride and sodium chloride from the strata forming the cavity walls, forming a working solution. When a solvent that is dilute in potassium chloride and rich in sodium chloride is fed to a cavity in contact with potassium chloride rich strata, an effluent solution will typically be recovered containing a substantially higher ratio of potassium chloride to sodium chloride than the solvent.

In conventional solution mining methods described in the prior art, the entire vertical extent of the cavity walls are in contact with an active working solution, i.e., a working solution to which solvent is being fed, into which salt from the cavity walls may be dissolving, and from which effluent is being withdrawn. This is accomplished by feeding solvent near the top of the cavity and withdrawing effluent near the bottom of the cavity. The effluent withdrawn near the bottom of the cavity is a concentrated solution of high density.

The effluent is withdrawn from the cavity to the surface. At the surface, the potassium chloride is concentrated and recovered. This may be accomplished by feeding the effluent to an evaporation pond, or to an evaporator-crystallizer where potassium chloride is recovered from the cavity effluent. The evaporator load is a function of the potassium chloride content of the effluent from the aqueous solution. The evaporator load is high for low potassium chloride contents and low for high potassium chloride contents. A saturated potassium chloride liquor is fed from the evaporator to the crystallizer while a sodium chloride slurry is recovered from the evaporator. The sodium chloride slurry may thereafter be mixed with make up water and utilized as an aqueous solvent to a solution mining cavity.

Under certain operating conditions, i.e., considerations of present and future evaporator loads based on present and projected potassium chloride concentrations in the effluent from the cavity, it may be advantageous to withdraw a solution mining cavity effluent having a potassium chloride to sodium chloride ratio significantly different from the average potassium chloride to sodium chloride ratio of the aqueous solution within the cavity. For example, in the upward development of the cavity through a stratum having a very low potassium chloride to sodium chloride ratio, it may be advantageous to pass through the stratum without reducing the potassium chloride to sodium chloride ratio of the aqueous working solution already present within the cavity. In this way, a long term increase in evaporator load may be avoided.

Similarly, in the upward development of the cavity through a stratum of high potassium chloride to sodium chloride, it may be advantageous to mine the stratum and quickly recover a cavity effluent undiluted in potassium chloride content, e.g., by mixing with the aqueous working solution in contact with the lower strata, thereby being able to operate at a low evaporator load.

It has now surprisingly been found that it is possible to preferentially mine one zone or level within the deposit, that is, one stratum, or one group of strata, or even one region of a single stratum, without affecting the salt content of the lower working solution in contact with lower strata. It has also surprisingly been found that aqueous potassium chloride-sodium chloride solutions may be maintained in contact with each other at an interface without mixing and without an immiscible organic fluid therebetween by maintaining the higher solution slighly less dense than the lower solution.

It has further surprisingly been found that the interface between the aqueous potassium chloride-sodium chloride solutions of different density, i.e., the working solutions, in a solution mining cavity may be formed by locating the tailpipe, i.e., the effluent withdrawal means, at the level of the intended interface and feeding a solvent into the cavity less dense than the lower working solution.

According to the method of this invention, a zone containing a potassium chloride lean stratum may be preferentially mined and withdrawn without diluting the potassium chloride to sodium chloride ratio in the subjacent aqueous working solution within the cavity. In this way, the upward development of the cavity may be accomplished without diluting the potassium chloride content of the effluent thereafter recovered from the cavity. This is accomplished by providing a first aqueous working solution in the cavity in contact with lower strata already mined, a less dense second aqueous working solution in contact with the zone to be preferentially mined and above the lower solution, with a quiescent interface between the two aqueous solutions, and withdrawing effluent from the less dense second aqueous working solution while maintaining the density of the second aqueous working solution less than the density of the subjacent aqueous working solution.

According to another exemplification, the working solution may have a low potassium chloride to sodium chloride ratio and a higher zone has a high potasssium chloride to sodium choride ratio. In such a deposit, it is advantageous to quickly recover a potassium chloride rich product without dilution of this product by a potassium chloride lean aqueous working solution subjacent thereto. This is accomplished by providing a lower or first working solution in contact with lower strata, a less dense second aqueous working solution in contact with the zone within the deposit being preferentially mined with a quiescent interface between the two solutions, and withdrawing effluent from the less dense second aqueous working solution while maintaining its density less than the density of the lower or first aqueous working solution.

BRIEF DESCRIPTION OF THE DRAWINGS

The method of this invention may be understood by reference to the appended Figures. In the Figures.

DETAILED DESCRIPTION OF THE INVENTION

Figure 1:
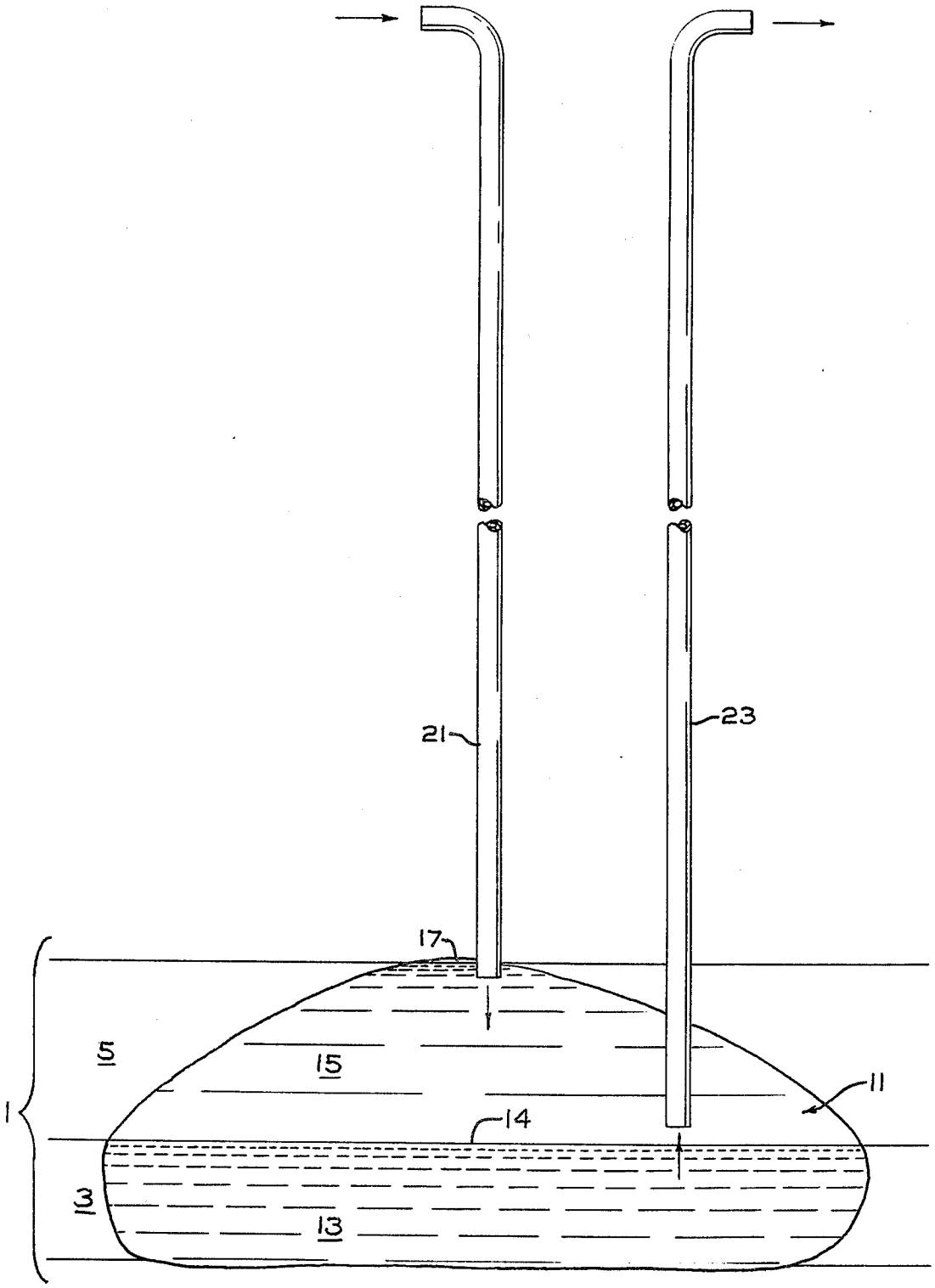
FIG. 1 is a schematic view of a solution mining cavity where a zone is being preferentially mined.

This invention relates to a solution mining technique for the preferential mining of a potassium chloride bearing stratum or strata above an aqueous working solution of different potassium chloride to sodium chloride ratio.

A "zone," as the term is used herein, is the region of interest within the cavity. It may be less than a stratum, a single stratum, or several strata.

The method of this invention may be used to preferentially mine those zones within the deposit capable of being preferentially mined, that is, those zones which are thick enough to permit preferential mining, for example, at least about 2 feet thick, and preferably from about 2 to about 10 feet thick. The method of this invention may be used to preferentially mine a zone or level of low potassium chloride content, basis total potassium chloride and sodium chloride in the zone, without diminution of the potassium chloride to sodium chloride ratio in the solution in contact with the lower portion of the cavity. For example, in the upward development of the solution mining cavity following a roof raise a zone several feet thick may be encountered having a potassium chloride content of less than about 15 weight percent, basis total potassium chloride and sodium chloride in the zone, while the solution in the cavity contains in excess of 140 grams per liter of potassium chloride. In such a situation, it may be desirable to preferentially mine the new zone in order to avoid dilution of the solution below the zone.

The method of this invention may also be used to preferentially mine potassium chloride from a potassium chloride rich zone above a low potassium chloride solution, that is, a zone containing from two to eight or more feet thick, containing in excess of about 35 weight percent potassium chloride, basis total potassium chloride and sodium chloride, above a working solution containing less than 100 grams per liter of potassium chloride, in order to quickly obtain an effluent of high potassium chloride content.

The above figures are illustrative of the method of this invention. The method of this invention may be used in preferentially mining potassium chloride in any situation where the potassium chloride or sodium chloride concentrations or the potassium chloride to sodium chloride ratio vary within the deposit, and the strata are thick enough to permit preferential mining, i.e., at least 2 feet thick.

According to the method of this invention, a solution mining cavity is developed within the deposit by methods well known in the prior art. Solution mining is most frequently carried out by laterally mining a layer, level, or horizontal zone of the mine. During the period of lateral development of the mine, vertical development is limited by the presence of a pad of an inert material of low capacity for dissolving salt and low water solubility interposed between the surface of the top of the cavity and the working solution within the cavity. As the cavity is developed horizontally additional inert pad material is fed to the cavity to prevent contact between the ceiling of the cavity and the working solution. The pad may be a gas pad, or it may be a water insoluble organic material such as a liquid hydrocarbon. Most frequently, it is a water insoluble liquid hydrocarbon. The horizontal development of the cavity may be continued until the layer, level, or zone is maturely mined. This is typically accomplished by feeding solvent in near the top of the cavity below the pad material and withdrawing effluent near the bottom of the cavity. That is, the horizontal development of the cavity within the layer may be continued until hydrodynamic considerations limit the recovery of material from the perimeter of the cavity or until roof fall becomes likely. At this point the layer, level, or zone may be considered to be maturely mined.

Thereafter the upward development of the cavity is commenced. This is referred to in the art as a roof raise. The feed pipe is drawn upward into the deposit and a portion of the pad is removed. The feed of solvent continues, resulting in conical, domed, or pyramidal upward development of the cavity in the vicinity of the feed means. When the roof raise has attained the desired increment, e.g., from about 4 feet to about 8 or 10, or 12 feet, the flow of the padding material to the cavity is resumed and the lateral development of the cavity into the deposit is continued, i.e., by placing the solvent feed near the top of the cavity and tail pipe near the bottom of the cavity. As the cavity becomes developed vertically, i.e., more than about 16 to 20 feet in height, the solution in lower regions of the cavity may become saturated. That is, the working solution in lower portions of the cavity may be incapable of dissolving additional potassium chloride or sodium chloride without crystallizing or depositing out previously dissolved salt. Solubility curves and saturation curves for the NaCl — KCl — $H_2O$ system are readily derivable, as are curves of density as a function of KCl and NaCl concentration.

During the upward development of the solution mining cavity, levels, zones, or strata may be encountered which are amenable to preferential mining. When such a level, zone, or stratum is encountered, the level is mined by injecting aqueous solvent having a density less than the density of the working solution already in the cavity below the bottom of the zone to be preferentially mined, into the cavity. This establishes a layer of a second aqueous working solution above the lower aqueous working solution. This second working solution dissolves the chloride salt, e.g., potassium chloride, from the higher zone, i.e., the zone to be preferentially mined, and is maintained less dense than the lower aqueous working solution. The effluent is withdrawn from a lower portion of the zone being preferentially mined.

The method of this invention is illustrated in FIG. 1. As there shown, the upward development of the cavity 11 into a zone or level 5 of the deposit 1 intended to be preferentially mined is initiated by drawing the solvent feed pipe 21 into the deposit, thereby forming a conical upward development in the roof of the cavity 1, until the pad 17 retards the upward development of the cavity.

The tail pipe means 23 are drawn up to the bottom of the zone 5 to be preferentially mined. A solvent having a lower density than the working solution 13 in the cavity below the zone to be preferentially mined is fed to the cavity through feed means 21. Effluent is withdrawn from the solution 15 in the upper portion of the cavity 11 in contact with the higher zone 5. The effluent has a lower density than the solution 13 within the cavity 11 below the zone 5 being preferentially mined, i.e., the solution 13 in contact with the lower zones 3.

As shown in the Figures, the second aqueous working solution 15 is in contact with the first aqueous solution 13 at an interface 14. The interface 14 is established by locating the tail pipe 23 in proximity to the bottom of the zone or level 5 to be preferentially mined. Typically, during conventional solution mining, the tail pipe 23 is at or near the bottom of the cavity 1. According to the method of this invention, the tail pipe 23 is drawn up to or just above the bottom of the stratum, zones, level, or region 5 to be preferentially mined, i.e., from about several inches to one foot above the bottom of the zone or level 5 to be preferentially mined. The particular distance above the bottom of the zone or level to be preferentially mined, i.e., above the intended top of the first aqueous working solution, is a function of the hydraulics of the tail pipe 23 in use. As a practical matter, the tail pipe has little hydraulic vertical draw up associated therewith. For this reason, liquid lying more than several inches. e.g., 4 or 6 inches to about 1 foot, below the tail pipe 23 will not be drawn into the tail pipe 23. The liquid lying below the tail pipe 23 can build up in density, e.g., up to almost the density of a saturated solution, i.e., a solution incapable of dissolving additional salt, without crystallizing out or depositing out previously dissolved salt.

When the liquid above the level of the tail pipe 23, i.e., the second aqueous solution 15, is maintained less dense than the liquid below the tail pipe 23, i.e., the first aqueous solution 13, an interface will form therebetween with little if any commingling across the interface. Generally, it is advantageous to maintain the density of the second aqueous working solution 15 at least about 0.001 and preferably at least about 0.002 gram per cubic centimeter lower than the density of the first aqueous working solution 13.

According to the method of this invention, effluent from the second aqueous working solution 15 is withdrawn from the solution mining cavity 1 while the second aqueous working solution 15 is maintained less dense than the first aqueous working solution 13. The difference in density between the solutions tends to maintain the solutions segregated in the vertical dimension at a quiescent interface without the use of organic materials or layers therebetween. Flow rates and salt concentrations of the solvent and the effluent are functions of the cavity diameter, the stratum being mined, and the evaporator-crystallizer plant. However, certain generalizations are applicable. As a general rule, increasing the residence time of the second aqueous working solution, as by reducing the feed and withdrawal rate, increases the density of the effluent. Reducing the residence time, as by increasing the feed and withdrawal rates, decreases the density of the effluent. The density of the first aqueous working solution will not decrease with time, and only the density of the second aqueous working solution need be monitored and controlled.

Additionally, the method may be used to proceed sequentially through a single thick stratum without disturbing the aqueous solution in contact with lower strata. For example, a single thick stratum, e.g., 10 or 20 or even 50 feet thick, of sodium chloride may be encountered in the upward development of a solution mining cavity. It may be desirable to mine this sodium chloride stratum without diluting the potassium chloride content of the first aqueous working solution. This sodium chloride rich stratum may be mined in small increments, e.g., 1, or 2, or 5, or 8, or even 10 foot increments. After one increment is mined, producing an aqueous working solution less dense than the aqueous working solutions therebelow, the solution can be allowed to grow denser and a higher increment can be preferentially mined using the method of this invention. This process may be continued upward through the stratum until the thick sodium chloride rich stratum is mined to the desired degree.

After the zone has been mined to the desired degree, i.e., to a target diameter, or even maturely mined, the solution in contact with the preferentially mined zone is allowed to grow more dense and ultimately commingle with the lower solution as shown in FIGS. 2 through 9 or the second aqueous solution may be withdrawn from the cavity by upward displacement by a more dense solution as shown in FIGS. 10 through 17.

Figure 2:
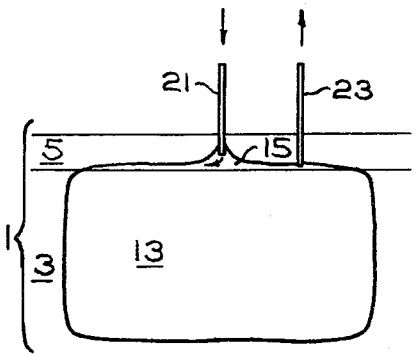
FIGS. 2 through 5 are schematic views of an exemplification of preferential zone mining showing the development of the zone and wherein the less dense solution is allowed to commingle with the more dense solution and conventional solution mining is resumed after the zone is preferentially mined.
Figure 3:
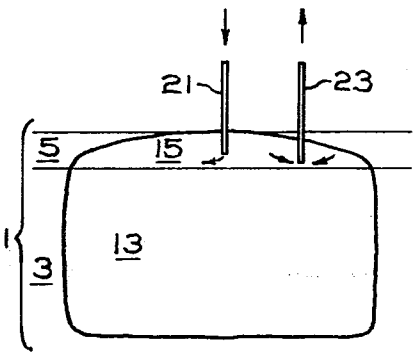
Figure 4:
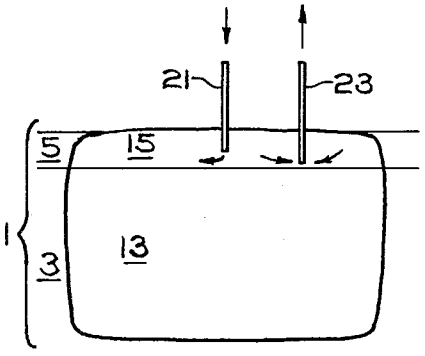
Figure 5:
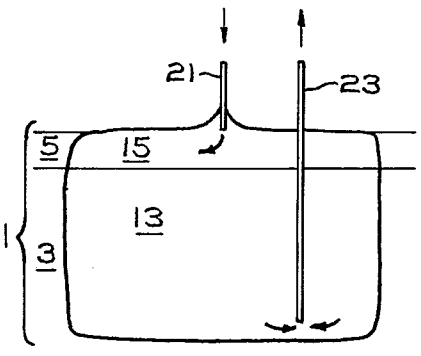

As shown in FIGS. 2 through 5, wherein like numbers indicate like parts, a zone may be preferentially mined by raising the roof as shown in FIG. 2, preferentially mining the zone as shown in FIG. 3, until a target diameter is attained as shown in FIG. 4, and then allowing the working solution in contact with the preferentially mined zone to commingle with the first aqueous working solution as effluent is withdrawn from below the level preferentially mined as shown in FIG. 5. This may be accomplished by lowering the tail pipe 23 into the first aqueous working solution below the zone preferentially mined and performing a roof raise, as shown in FIG. 5. This will most often be the case where the zone preferentially mined was a potassium chloride rich zone and commingling of the solutions enriches the subjacent working solution.

Figure 6:
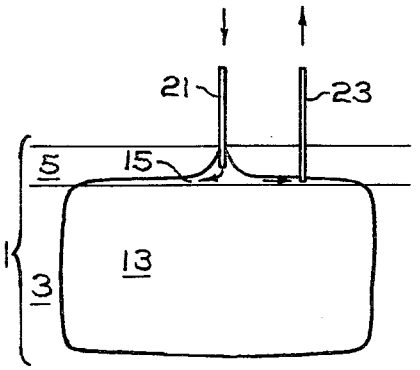
FIGS. 6 through 9 are schematic views of an exemplification of preferential zone mining showing the development of the zone and wherein the less dense solution is allowed to commingle with the more dense solution, and a higher zone is preferentially mined after the lower zone.
Figure 7:
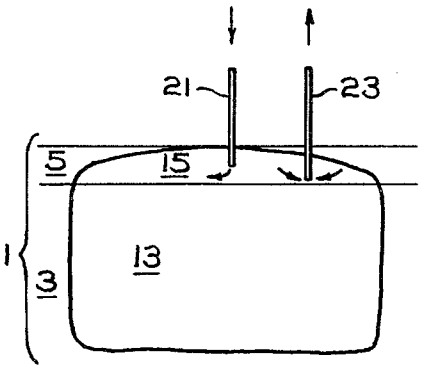
Figure 8:
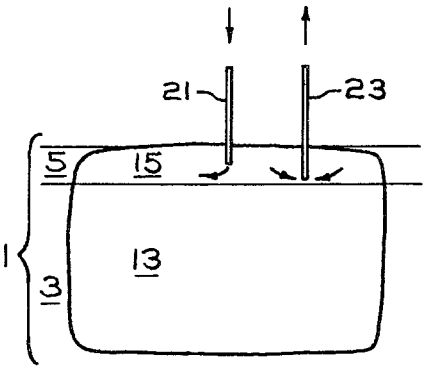
Figure 9:
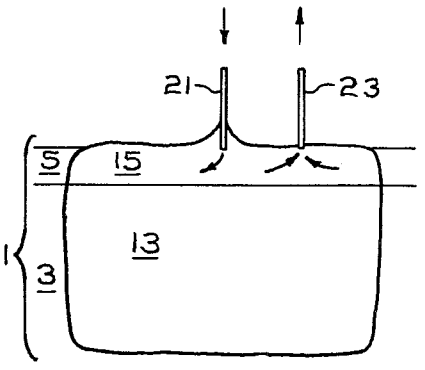

Alternatively, the solutions may be permitted to commingle as a higher zone or level is preferentially mined, as shown in the sequence of FIGS. 6 through 9, especially FIG. 9 wherein like numbers indicate like parts. As shown in FIG. 6, a roof raise is accomplished, the zone is then preferentially mined, as shown in FIG. 7, to a target diameter as shown in FIG. 8, and the tail pipe 23 is then raised above the zone preferentially mined to preferentially mine a higher zone, as shown in FIG. 9.

According to alternative exemplifications of this invention illustrated in FIGS. 10 through 17, wherein like numbers indicate like parts, the second aqueous solution is withdrawn from the cavity by upward displacement by a more dense working solution. In the exemplification there shown, after a roof raise, FIGS. 10 and 14, a zone is preferentially mined, FIGS. 11 and 15, to a target diameter.

Figure 12:
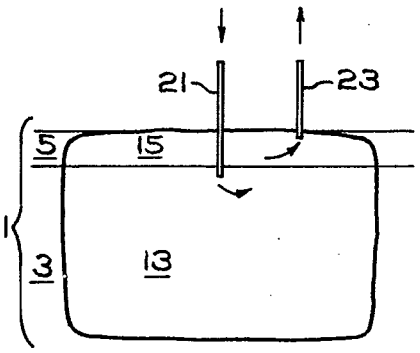
Figure 11:
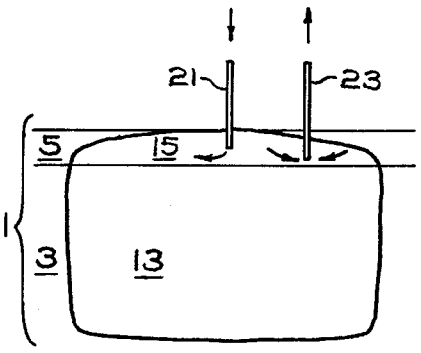
Figure 10:
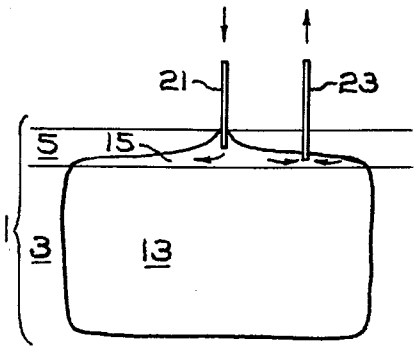
Figure 16:
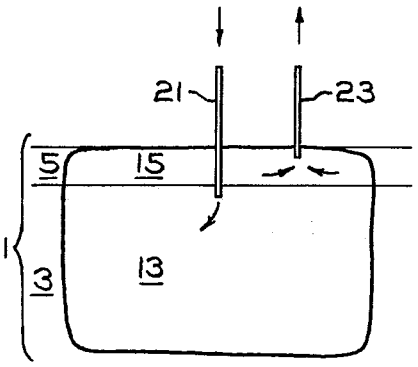
Figure 15:
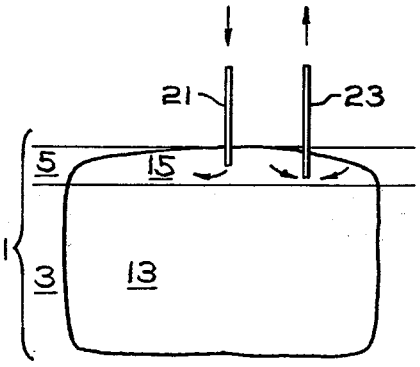
Figure 14:
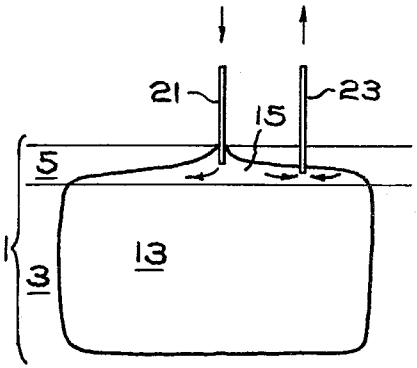

Thereafter, as shown in FIGS. 12 and 16, a working solution that is more dense than the working solution in contact with the zone preferentially mined is fed to the cavity, preferably below the interface. Effluent is recovered from an upper portion of the cavity, that is, from an upper portion of the preferentially mined zone. In this way, the less dense working solution is displaced upward. This is accomplished by positioning the tail pipe 23 in an upper region of the zone and feeding a solution to the cavity which is more dense than the working solution in contact with the preferentially mined zone. For example, when the second working solution in contact with the preferentially mined zone has a density of 1.19, a solution can be fed to the cavity having a density of 1.21, thereby displacing the original second working solution in contact with the preferentially mined zone upward. Typically, the zone preferentially mined in this exemplification is a potassium chloride lean zone.

Figure 13:
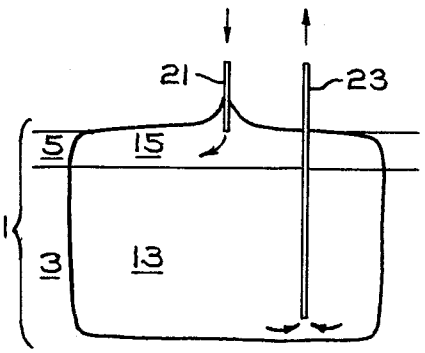
FIGS. 10 through 13 are schematic views of an exemplification of preferential zone mining showing the development of the zone and wherein the less dense solution is displaced upward by a more dense solution, and thereafter conventional solution mining is resumed.
Figure 17:
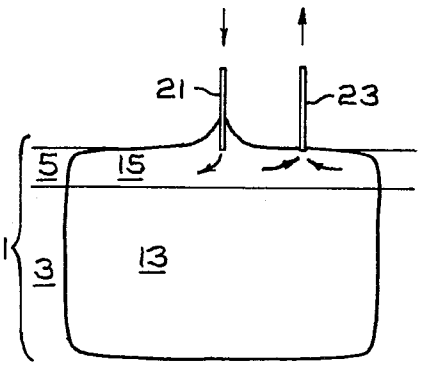
FIGS. 14 through 17 are schematic views of an exemplification of preferential zone mining showing the development of the zone and wherein the less dense solution is displaced upward by a more dense solution, and thereafter a higher zone is preferentially mined.

After preferential mining of the zone and upward displacement of the second working solution by the more dense solution, a roof raise may be accomplished and the tail pipe may be lowered, and the solutions allowed to commingle, as shown in FIG. 13. Alternatively, the roof raise may be accomplished and the subsequent layer preferentially mined as shown in FIG. 17.

According to the method of this invention, water or other solvent may be injected into an upper region of the solution mining cavity, e.g., near the top of the second aqueous working solution 15, and the second aqueous working solution 15 is withdrawn as effluent from the solution mining cavity 1 near the bottom of the second aqueous working solution 15 but above the top of the first aqueous solution 13. Alternatively, the water or other solvent may be added to the cavity 1 below the level of the tail pipe 23, for example, by addition to the lower, more dense working solution 13, with effluent from the second aqueous working solution 15 recovered near the bottom of the second aqueous working solution 15 so that the level of the inlet 21 is below the level of the tail pipe 23.

Normally the inlet 21 is above the tail pipe 23 by from about 1 foot to about 10 feet and preferably from about 2 feet to 8 feet. The outlet of the feed line 21 may be laterally spaced from the inlet of the tail pipe 23 so as to provide horizontal flow of the solution 15 within the cavity 1. The two pipes 21 and 23 may be adjacent, or they may be spaced from each other by as much as two-thirds or even three-quarters of the diameter of the cavity. Alternatively, the feed means, e.g., feed line 21 and the withdrawal means, e.g., tail pipe 23, may be concentric, either with the effluent line 21 within the tail pipe 23 or with the tail pipe 23 within the feed pipe 21.

The second aqueous working solution 15 is maintained at a lower density than the lower or first aqueous solution 13, for example, by monitoring the effluent therefrom and comparison of the effluent with the first aqueous working solution. Typically, the difference in density between the two phases is from about 0.002 grams per cubic centimeter to about 0.010 grams per cubic centimeter, although differences as small as about 0.001 grams per cubic centimeter may be used, and even density differences even lower than 0.001 grams per cubic centimeter may be utilized if care is taken in the feed of the solvent and recovery of effluent from the second aqueous working solution 15.

The denser first aqueous working solution 13 may be obtained in a number of ways. It may be the aqueous working solution in the cavity at the time the effluent outlet, tail pipe 23, is raised. It may be sodium chloride from the evaporator with make up water. It may be obtained by enrichment, i.e., permitting the solution 13 to remain in the cavity 1 until it attains a high density. Alternatively, the first aqueous working solution 13 may be a sodium chloride rich brine obtained from another cavity and fed into the solution mining cavity 1 being mined, where it selectively solubilizes potassium chloride until it attains the desired density. Or, the first aqueous working solution 13 may be a dense potassium chloride-sodium chloride solution built up in another cavity and fed to the cavity 1.

According to the method described herein, the interface between the two phases remains substantially quiescent and the first aqueous working solution 13 is maintained more dense than the second aqueous working solution 15 by controlling the salt concentrations of the second aqueous working solution 15 as described hereinabove. Concentrations of potassium chloride and sodium chloride in the second aqueous working solution may be determined by sampling the solution in accordance with well-known techniques. The second aqueous working solution 15 may be continuously analyzed or semi-continuously analyzed during or after its withdrawal from the solution mining cavity.

The method of this invention may be understood by reference to the following example.

EXAMPLE

A solution mining cavity is established in a subterranean deposit of sodium chloride and potassium chloride approximately 5400 feet below the surface by conventional techniques, such as described in U.S. Pat. No. 3,096,969. The feed to the cavity is an aqueous solvent containing approximately 100 grams per liter of sodium chloride and approximately 10 grams per liter of potassium chloride. A zone is mined and a product containing approximately 248 grams per liter of sodium chloride and 155 grams per liter of potassium chloride and having a density of about 1.229 grams per liter is withdrawn from the cavity. The solvent inlet is maintained near the top of the cavity and the tail pipe, i.e., effluent outlet, is positioned near the bottom of the cavity. This operation is continued until the upward development of the cavity uncovers a KCl rich stratum.

At this time, feed of solvent and withdrawal of effluent are stopped and the feed and effluent lines are adjusted for preferential mining. The effluent outlet is drawn up to the lower boundary of the higher stratum while the solvent inlet is maintained about 2 to 8 feet above the effluent outlet. Thereafter, operation is resumed with water as the aqueous extracting solution. An effluent containing about 180 grams per liter of potassium chloride, about 240 grams per liter of sodium chloride, and having a density of about 1.225 grams per liter is recovered.

The density difference is maintained by increasing the flow and withdrawal rates when the density of the effluent increases and decreasing the flow and withdrawal rates when the density of the effluent decreases.

Preferential mining of the stratum continues until the stratum is maturely mined.

While the invention has been described with reference to certain specific ore concentrations and solution mining techniques and equipment, its use is not intended to be so limited except as described in the hereinafter appended claims.

I claim:

1. In a method of solution mining chloride salt from a stratified subterranean deposit of at least two chloride salts wherein the ratio of the chloride salts to each other varies between strata within the deposit which method comprises establishing a solution mining cavity in said deposit, feeding aqueous solvent into the solution mining cavity thereby dissolving chloride salts from the deposit to form a first aqueous working solution within the cavity, mining upwardly through said deposit, and withdrawing first working solution as an aqueous effluent from the cavity, the improvement comprising:

feeding aqueous solvent into said cavity and withdrawing first aqueous working solution effluent from said cavity until a preferentially minable higher zone having a different ratio of chloride salts than the layer subjacent thereto is reached;

injecting aqueous solvent having a density less than the density of said first aqueous working solution into the cavity above the surface of said aqueous working solution and above the bottom of the zone being preferentially mined;

dissolving chloride salts from the higher zone into said less dense aqueous solvent whereby to establish a layer of a second aqueous working solution; and withdrawing effluent from the second aqueous working solution within said cavity near the bottom of the zone being preferentially mined, while maintaining said second aqueous working solution less dense than said first aqueous working solution and substantially undiluted by said first aqueous working solution, said effluent having a higher salt content than said less dense aqueous solvent.

2. In a method of solution mining potassium chloride from a stratified subterranean deposit of potassium chloride and sodium chloride salts wherein the ratio of potassium chloride to sodium chloride varies between strata within the deposit which method comprises establishing a solution mining cavity in said deposit, feeding aqueous solvent into the solution mining cavity thereby dissolving chloride salts from the deposit and forming a first aqueous working solution in the cavity, and withdrawing first aqueous working solution effluent from the cavity, the improvement comprising:

feeding the aqueous solvent into said cavity forming the first aqueous working solution, withdrawing effluent of said first aqueous working solution, and mining upwardly through said deposit until a preferentially minable higher level having a different ratio of chloride salts is reached;

injecting aqueous solvent having a density less than the density of said first aqueous working solution already in the cavity into the cavity above the bottom of the level being preferentially mined and above said first aqueous working solution;

dissolving potassium chloride from said preferentially minable higher level into said less dense aqueous solvent whereby to establish a second aqueous working solution above the surface of the first aqueous working solution; and withdrawing as effluent from the cavity second aqueous working solution having a higher chloride content than said less dense aqueous solvent while maintaining said second aqueous working solution less dense than said first aqueous working solution.

3. The method of claim 2 comprising mining said preferentially minable level and thereafter withdrawing effluent from below the level preferentially mined.

4. The method of claim 2 comprising mining said level and thereafter preferentially mining a still higher level.

5. The method of claim 2 comprising:

preferentially mining said level;

feeding an aqueous salt solution more dense than the second aqueous working solution to the cavity; and withdrawing second aqueous working solution as effluent from said cavity.

6. The method of claim 2 wherein the solvent is chosen from the group consisting of water, aqueous sodium chloride solutions, aqueous potassium chloride solutions, and aqueous potassium chloride-sodium chloride solutions.

7. In a method of solution mining potassium chloride from a stratified subterranean deposit of chloride salts of varying composition within the deposit which method comprises:

establishing a solution mining cavity in the deposit;
feeding aqueous solvent into the cavity through feed pipe means whereby to form a first aqueous working solution within the cavity; and
withdrawing effluent of the first aqueous working solution through tail pipe means from said cavity;
the improvement comprising:
positioning the tail pipe means at the bottom of a zone to be preferentially mined while maintaining said feed means above said tail pipe;
feeding solvent to the cavity, said solvent having a lower density than the first aqueous working solution in the cavity below the zone to be preferentially mined;
forming a second aqueous working solution in contact with the zone being preferentially mined;
maintaining said second aqueous working solution less dense than said first aqueous working solution; and
withdrawing effluent from the second aqueous working solution in the cavity, said effluent having a lower density than the first aqueous working solution within the cavity below the zone being preferentially mined and a higher chloride content than said aqueous feed.

8. The method of claim 7 comprising mining said zone and thereafter lowering the tail pipe into the solution below the zone preferentially mined.

9. The method of claim 8 wherein the zone being preferentially mined is a potassium chloride rich zone.

10. The method of claim 7 comprising mining said zone, raising the roof of the cavity, and raising the tail pipe to preferentially mine a higher zone.

11. The method of claim 10 wherein the zone being preferentially mined is a potassium chloride rich zone.

12. The method of claim 7 comprising:
preferentially mining said zone;
thereafter positioning the tail pipe in an upper region of said zone; and
feeding an aqueous solution to the cavity, said solution being more dense than the second aqueous working solution removed from said preferentially mined zone.

13. The method of claim 12 wherein said more dense solution is an aqueous solution saturated in sodium chloride.

14. The method of claim 12 wherein the zone being preferentially mined is a potassium chloride lean zone.

15. The method of claim 7 wherein the effluent has a density of at least 0.001 grams per cubic centimeter less than the solution within the cavity below the zone being preferentially mined.

16. In a method of solution mining potassium chloride from a stratified subterranean deposit of potassium chloride and sodium chloride salts at varying concentrations within the deposit which method comprises establishing a solution mining cavity in said deposit, feeding solvent into the solution mining cavity thereby dissolving chloride salts from the deposit and forming an aqueous working solution in the cavity, and withdrawing aqueous effluent from the cavity, the improvement comprising:
feeding aqueous solvent into said cavity, forming a first aqueous working solution, withdrawing effluent of said first aqueous working solution, and mining upwardly through said stratified deposit until a preferentially minable level having a different ratio of potassium chloride to sodium chloride than the layer subjacent thereto is reached;
injecting aqueous solvent having a density less than the density of said first aqueous working solution already in the cavity into the cavity above the bottom of the level being preferentially mined and above the surface of said first aqueous working solution;
dissolving potassium chloride from said preferentially minable level into said less dense aqueous solvent whereby to establish a second aqueous working solution above the surface of the first aqueous working solution;
withdrawing as effluent from the cavity second aqueous working solution while maintaining said second aqueous working solution less dense than said first aqueous working solution until said level has been mined to a desired degree;
thereafter feeding an aqueous solution more dense than the second aqueous working solution to the cavity; and
withdrawing second aqueous working solution as effluent from said cavity.

17. The method of claim 16 wherein the aqueous solvent is chosen from the group consisting of water, aqueous sodium chloride solution, aqueous potassium chloride solution, and aqueous potassium chloride-sodium chloride solutions.

18. In a method of solution mining potassium chloride from a stratified subterranean deposit of chloride salts which method comprises:
establishing a solution mining cavity in the deposit;
feeding aqueous solvent into the cavity through feed pipe means whereby to form an aqueous working solution within the cavity; and
withdrawing aqueous effluent of the aqueous working solution through tail pipe means from said cavity;
the improvement comprising:
solution mining upwardly through said stratified subterranean deposit until a zone to be preferentially mined is reached;
raising the tail pipe means to the bottom of the zone to be preferentially mined;
feeding aqueous solvent to the cavity, said solvent having a lower density than the aqueous working solution in the cavity below the zone to be preferentially mined;
withdrawing effluent from the cavity, said effluent having a lower density than the aqueous working solution within the cavity below the zone being preferentially mined; and
solution mining said zone to a desired extent, raising the roof of the cavity, and raising the tail pipe to preferentially mine a higher zone.

19. The method of claim 18 wherein the zone being preferentially mined is a potassium chloride rich zone.

20. In a method of solution mining potassium chloride from a stratified subterranean deposit of chloride salts which method comprises:
establishing a solution mining cavity in the deposit;
feeding aqueous solvent into the cavity through feed pipe means whereby to form an aqueous working solution within the cavity; and
withdrawing aqueous effluent of the aqueous working solution through tail pipe means from said cavity;
the improvement comprising:

solution mining upwardly through said stratified subterranean deposit until a zone to be preferentially mined is reached;

raising the tail pipe means to the bottom of the zone to be preferentially mined;

feeding aqueous solvent to the cavity, said aqueous solvent having a lower density than the aqueous working solution in the cavity below the zone to be preferentially mined;

withdrawing effluent from the cavity, said effluent having a lower density than the aqueous working solution within the cavity below the zone being preferentially mined;

preferentially mining said zone to a desired extent;

thereafter positioning the tail pipe in an upper region of said preferentially mined zone;

feeding a solution to the cavity, said solution being more dense than the less dense solution removed from said preferentially mined zone whereby to displace said less dense solution upward; and removing said less dense solution from the cavity.

21. The method of claim 20 wherein said more dense solution is an aqueous solution saturated in sodium chloride.

22. The method of claim 20 wherein the zone being preferentially mined is a potassium chloride lean zone.

* * * * *